US009811036B2

(12) United States Patent
Fujita et al.

(10) Patent No.: US 9,811,036 B2
(45) Date of Patent: Nov. 7, 2017

(54) BELT DEVICE AND IMAGE FORMING APPARATUS INCLUDING SAME

(71) Applicants: Junpei Fujita, Kanagawa (JP); Kenji Sugiura, Kanagawa (JP); Yuuji Wada, Kanagawa (JP); Hiroyoshi Haga, Kanagawa (JP); Seiichi Kogure, Kanagawa (JP); Naohiro Kumagai, Kanagawa (JP); Kazuki Yogosawa, Kanagawa (JP)

(72) Inventors: Junpei Fujita, Kanagawa (JP); Kenji Sugiura, Kanagawa (JP); Yuuji Wada, Kanagawa (JP); Hiroyoshi Haga, Kanagawa (JP); Seiichi Kogure, Kanagawa (JP); Naohiro Kumagai, Kanagawa (JP); Kazuki Yogosawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/269,093

(22) Filed: Sep. 19, 2016

(65) Prior Publication Data

US 2017/0090374 A1 Mar. 30, 2017

(30) Foreign Application Priority Data

Sep. 28, 2015 (JP) ..... 2015-189244

(51) Int. Cl.

| | |
|---|---|
| ***G03G 15/01*** | (2006.01) |
| ***G03G 15/00*** | (2006.01) |
| ***G03G 15/16*** | (2006.01) |

(52) U.S. Cl.

CPC ..... *G03G 15/5054* (2013.01); *G03G 15/162* (2013.01); *G03G 15/1615* (2013.01)

(58) Field of Classification Search

CPC ..... G03G 15/1615; G03G 15/162; G03G 15/5054

See application file for complete search history.

(56) References Cited

U.S. PATENT DOCUMENTS

| | | | | |
|---|---|---|---|---|
| 7,258,414 | B2 * | 8/2007 | Satoh | B41J 11/007 347/19 |
| 2006/0061612 | A1 | 3/2006 | Satoh | |
| 2011/0206399 | A1 | 8/2011 | Fujita et al. | |
| 2015/0268591 | A1 | 9/2015 | Fujita et al. | |

FOREIGN PATENT DOCUMENTS

| | | |
|---|---|---|
| JP | 2006-6083 A | 1/2006 |
| JP | 2006-085105 | 3/2006 |
| JP | 2006-215071 | 8/2006 |
| JP | 2007-156194 A | 6/2007 |
| JP | 2012-230298 | 11/2012 |

OTHER PUBLICATIONS

Extended European Search Report dated Mar. 17, 2017 in Patent Application No. 16187516.6.

* cited by examiner

*Primary Examiner* — Hoang Ngo
(74) *Attorney, Agent, or Firm* — Oblon, McClelland, Maier & Neustadt, L.L.P.

(57) ABSTRACT

An endless rotatable belt device including an endless rotatable belt, a scale tape bonded on the belt, at least one optical sensor to detect a scale pattern, and auxiliary tape to cover at least one of the first end and the second end of the scale tape of the belt. The scale tape has a first end and a second end and includes at least one scale pattern. The auxiliary tape has a lower surface friction coefficient than the surface friction coefficient of the scale tape.

11 Claims, 8 Drawing Sheets

BELT DEVICE AND IMAGE FORMING APPARATUS INCLUDING SAME

CROSS-REFERENCE TO RELATED APPLICATION

This patent application is based on and claims priority pursuant to 35 U.S.C. §119(a) to Japanese Patent Application No. 2015-189244, filed on Sep. 28, 2015, in the Japan Patent Office, the entire disclosure of which is hereby incorporated by reference herein.

BACKGROUND

Technical Field

Embodiments of the present disclosure generally relate to a belt device that includes a belt, such as an intermediate transfer belt, a transfer belt, a photoconductor belt, or a fixing belt, to move in a predetermined direction, and an image forming apparatus, such as a copier, a printer, a facsimile machine, or multifunction peripheral (MFP) including a combination of the copier, the printer, and the facsimile machine.

Related Art

An image forming apparatus, such as a copier and a printer, typically includes an endless belt, such as an intermediate transfer belt, and a scale tape, such as a scale or a linear scale. The scale tape is bonded along a lateral edge of the belt to help stabilize the belt as the belt moves. A scale pattern is formed on the surface of the scale tape and is optically detected by an optical sensor. The image forming apparatus controls the drive of the belt in response to the detection results provided by the sensor.

SUMMARY

In an aspect of this disclosure, there is provided a belt device including an endless rotatable belt, a scale tape bonded on the belt, an optical sensor to detect the scale pattern, and an auxiliary tape. The scale tape has a first end and a second end and includes a scale pattern. The auxiliary tape covers at least one of the first end and the second end of the scale tape on the belt. The auxiliary tape has a lower surface friction coefficient than a surface friction coefficient of the scale tape.

In another aspect of this disclosure, there is provided an image forming apparatus including the belt device described above.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 9A:
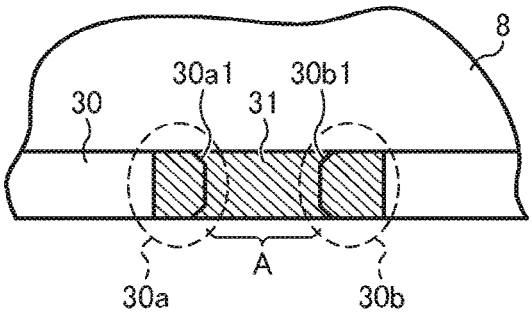
Figure 9B:
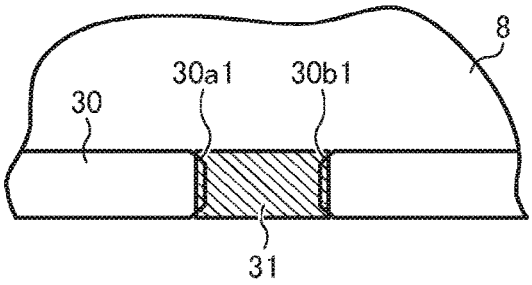
Figure 9C:
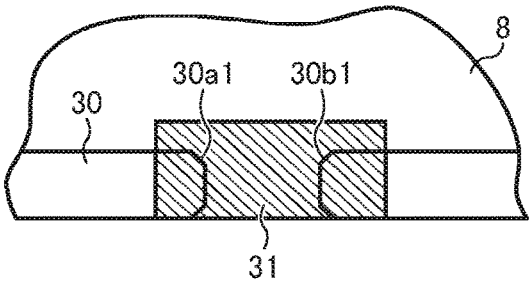
Figure 10A:
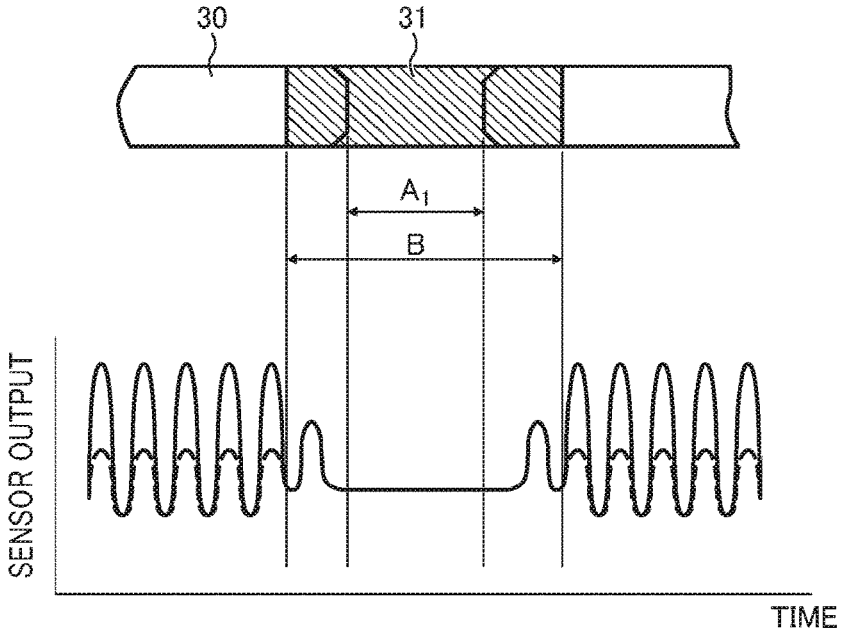
Figure 10B:
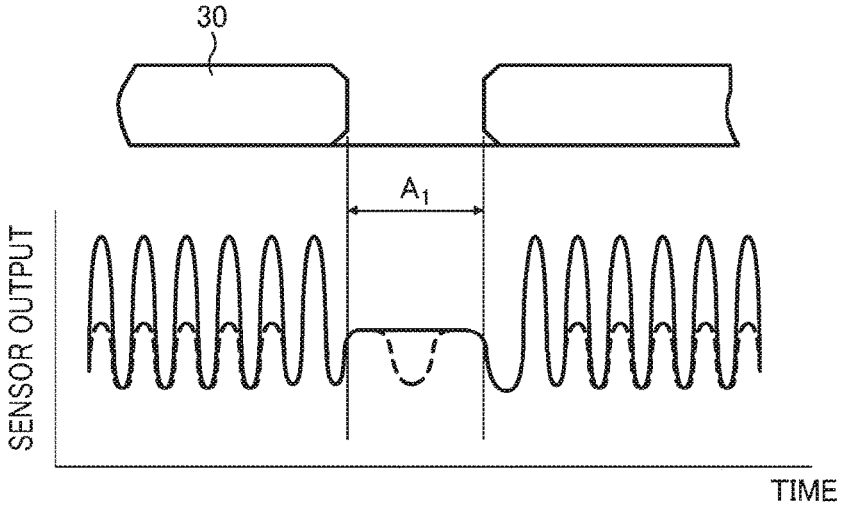
Figure 11:
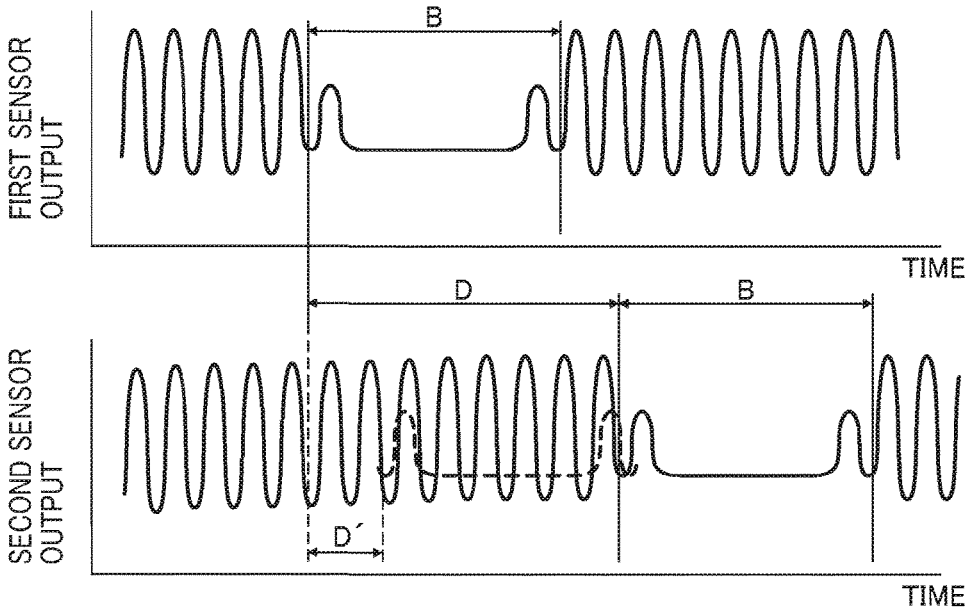
Figure 12:
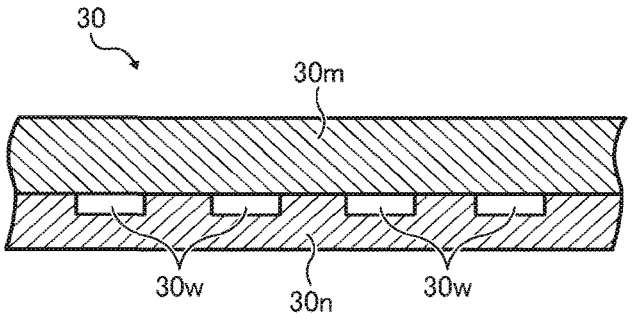
Figure 13:
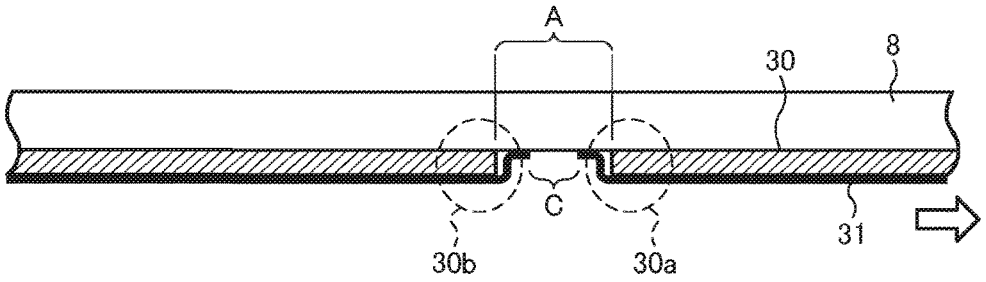
Figure 14:
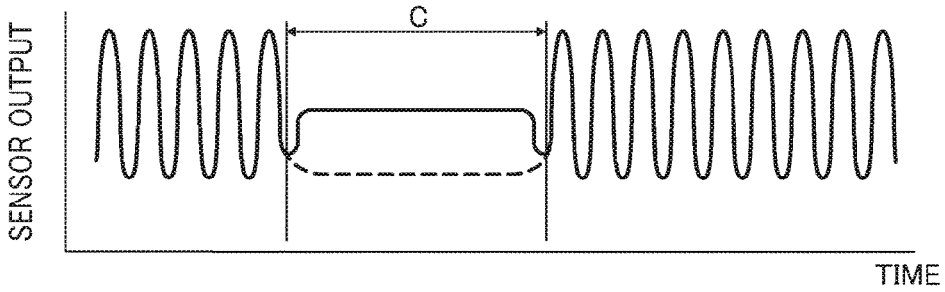

Each of FIGS. 9A through 9C is an enlarged view of a part in the vicinity of an auxiliary tape;

Each of FIGS. 10A and 10B is a graph of an output waveform of one optical sensor when a gap between the ends of a scale tape passes by the optical sensor;

FIG. 11 is a graph of output waveforms of two optical sensors when a gap between the ends of a scale tape passes by the two optical sensors;

FIG. 12 is an enlarged cross-sectional view of the scale tape according to an embodiment of the present disclosure;

FIG. 13 is a cross-sectional view of a portion of the intermediate transfer belt according to another embodiment of the present disclosure; and FIG. 14 is a graph of output waveform from an optical sensor when a gap between the ends of a scale tape passes by the optical sensor in the intermediate transfer belt of FIG. 13 according to another embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

The following describes the embodiments of the present disclosure, referring to FIGS. 1 through 14. The same reference numerals and symbols are given to constituent elements such as parts and materials having the same functions, and the descriptions of the same parts and materials will be omitted.

A detailed description is provided below of an aspect according to an (a first) embodiment referring to FIGS. 1 through 12.

First, a configuration and operation of an image forming apparatus 100 according to the present embodiment is described below.

Figure 1:
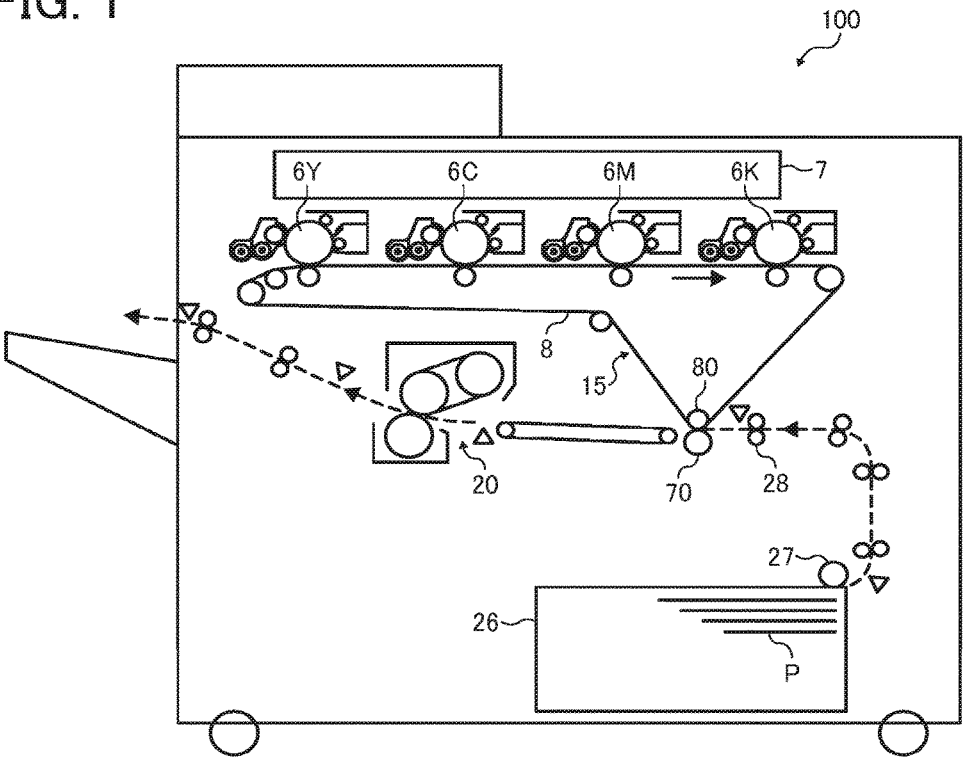
FIG. 1 is a schematic view of an image forming apparatus according to an embodiment of the present disclosure.
Figure 2:
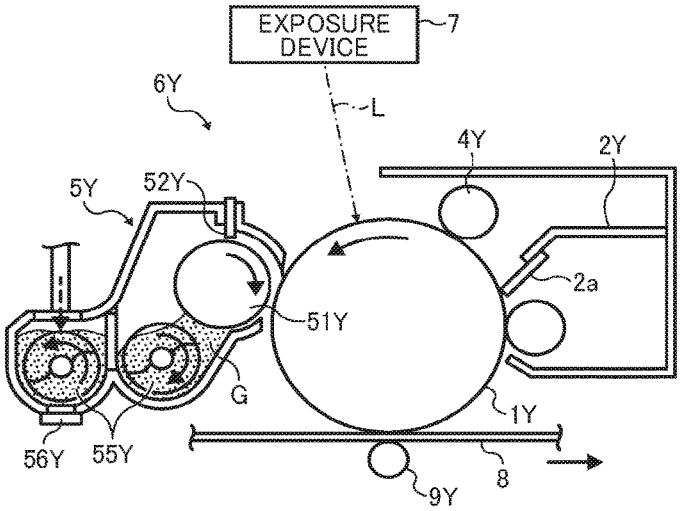
FIG. 2 is a partial enlarged view of an image forming unit of the image forming apparatus according to an embodiment of the present disclosure.

FIG. 1 is a schematic view of the image forming apparatus 100 as a printer. FIG. 2 is an enlarged view of an image forming unit 6Y (for yellow as a representative) of the image forming apparatus 100 of FIG. 1.

As illustrated in FIG. 1, the image forming apparatus 100 includes an intermediate transfer belt device 15 as a belt device in the center of an apparatus body. The image forming apparatus further includes image forming units 6Y, 6M, 6C, and 6K respectively corresponding to yellow, magenta, cyan, and black disposed facing the intermediate transfer belt 8 of an intermediate transfer belt device 15. The image forming units 6Y, 6M, 6C, and 6K are referred to collectively as the image forming unit 6.

Referring to FIG. 2, the image forming unit 6Y for yellow includes a photoconductor drum 1Y as an image bearer, a charger 4Y, a developing device 5Y, a cleaning device 2Y, and a discharger, which are provided around the photoconductor drum 1Y. Image forming processes including charging, exposure, development, transfer, and cleaning processes are performed on the photoconductor drum 1Y, and thus a yellow toner image is formed on the photoconductor drum 1Y.

The other image forming units 6M, 6C, and 6K have the same configuration as the image forming unit 6Y, except for the difference in color of toner employed, generating the toner images for the respective colors. Hereinafter, only a description is provided of the image forming unit 6Y for yellow as a representative. The description of the image forming units 6M, 6C, and 6K for other colors is omitted as appropriate.

Referring to FIG. 2, a motor drives the photoconductor drum 1Y to rotate in the counterclockwise direction. The charger 4Y uniformly charges a surface of the photoconductor drum 1Y at a position facing the charger 4Y (charging process).

Then, the charged surface of the photoconductor drum 1Y reaches a position to receive a laser beam L from an exposure device 7, getting exposed to scanning, thus forming an electrostatic latent image of yellow at the position (an exposure process).

The surface of the photoconductor drum 1Y bearing the electrostatic image reaches a position facing the developing device 5Y, and the electrostatic latent image is developed into a toner image of yellow (developing process).

When the surface of the photoconductor drum 1Y bearing the toner image reaches a position facing a primary-transfer roller 9Y via the intermediate transfer belt 8 as an image bearer, the toner image is transferred from the photoconductor drum 1Y onto the intermediate transfer belt 8 (primary transfer process). After the primary transfer process, a certain amount of toner tends to remain untransferred on the photoconductor drum 1Y.

When the surface of the photoconductor drum 1Y reaches a position facing the cleaning device 2Y, a cleaning blade 2*a* of the cleaning device 2Y mechanically collects the untransferred toner on the photoconductor drum 1Y (cleaning process).

Subsequently, the surface of the photoconductor drum 1Y reaches a position facing the discharger, and the discharger removes potentials remaining on the surface of the photoconductor drum 1Y.

Thus, a sequence of image forming processes performed on photoconductor drum 1Y is completed.

The above-described image forming processes are performed in the image forming units 6M, 6C, and 6K similar to the yellow image forming unit 3Y. That is, the exposure device 7 disposed above the image forming unit 6 (6Y, 6C, 6M, and 6K) irradiates the photoconductor drum 1 of the image forming unit 6 with the laser beam L according to image data. Specifically, the exposure device 7 includes light sources to emit the laser beams L, polygon mirror driven to rotate, and a plurality of optical elements. The polygon mirror causes the laser beam L to scan the photoconductor drum 1 via the multiple optical elements.

Then, the toner images formed on the respective photoconductor drums 1 through the development process are primarily transferred onto and superimposed one on another on the intermediate transfer belt 8. Thus, a multicolor toner image is formed on the intermediate transfer belt 8.

Figure 3:
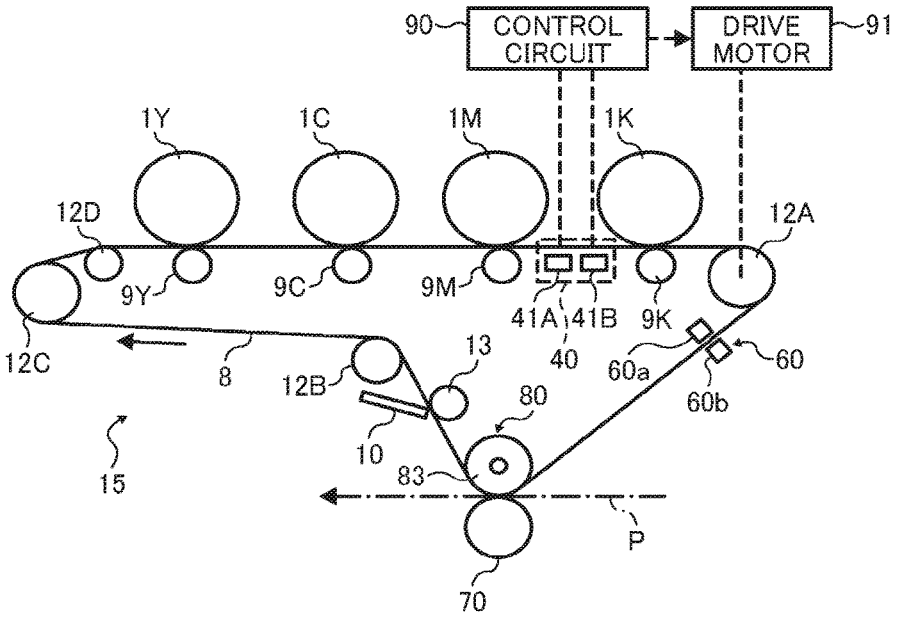
FIG. 3 is a schematic view of an intermediate transfer belt device according to an embodiment of the present disclosure.

Referring now to FIG. 3, the intermediate transfer device 15 as the belt device includes the intermediate transfer belt 8 as a belt, four primary-transfer rollers 9Y, 9M, 9C, and 9K, a drive roller 12A, a secondary-transfer second roller 80, a tension roller 12B, driven rollers 12C and 12D, a cleaning roller 13, a belt cleaner 10, a secondary-transfer first roller 70, and a sensor unit 40. The intermediate transfer belt 8 is extended taut over a plurality of rollers 80, 12A through 12D, and 13, and is endlessly rotated by the drive roller 12A driven by the drive motor 91 in the direction indicated by arrow Y in FIG. 3.

Specifically, the four primary transfer rollers 9Y, 9M, 9C, and 9K are pressed against the photoconductor drums 1Y, 1M, 1C, and 1K, respectively via the intermediate transfer belt 8 to form the primary transfer nips between the primary transfer rollers 9Y, 9M, 9C, and 9K and the respective photoconductor drums 1Y, 1M, 1C, and 1K. Each primary transfer roller 9 receives a transfer voltage (primary transfer bias) having a polarity opposite to the polarity of toner.

While rotating in the direction indicated by arrow Y, the intermediate transfer belt 8 sequentially passes through the primary transfer nips between the photoconductor drums 1Y, 1M, 1C, and 1K and the respective primary transfer rollers 9Y, 9M, 9C, and 9K. Then, the toner images of colors on the photoconductor drums 1Y, 1M, 1C, and 1K, respectively are primarily transferred onto and superimposed one on another on the intermediate transfer belt 8.

Then, the intermediate transfer belt 8 bearing the multicolor toner image reaches a position facing the secondary-transfer first roller 70. At that position, the secondary-transfer second roller 80 contacts the secondary-transfer first roller 70 via the intermediate transfer belt 8 to form a secondary transfer nip. The multicolor (four-color) toner image on the intermediate transfer belt 8 is transferred onto a recording sheet P as a recording media transported to the secondary transfer nip. In this case, a certain amount of toner untransferred onto the recording sheet P tends to remain on the intermediate transfer belt 8 after the secondary transfer process.

Further, the surface of the intermediate transfer belt 8 bearing the untransferred toner reaches a position facing the belt cleaner 10. Then, the untransferred toner remaining on the intermediate transfer belt 8 is collected by the belt cleaner 10.

Thus, a sequence of transfer processes performed on the intermediate transfer belt 8 is completed.

Referring back to FIG. 1, the recording sheet P is transported from a sheet feeding tray 26 provided in a lower portion of the body of the image forming apparatus 100 to the secondary transfer nip via a sheet feeding roller 27 and registration rollers 28.

More specifically, the sheet feeding tray 26 contains multiple recording sheets P piled one on another. The sheet feeding roller 27 rotates counterclockwise in FIG. 1 to feed the recording sheet P on the top contained in the sheet feeding tray 26 toward a nip between the registration rollers 28.

Registration rollers 28 stop rotating temporarily, stopping the recording sheet P with a leading edge of the recording sheet P stuck in the nip of the registration rollers 28. The registration rollers 28 resumes rotating to transport the recording sheet P to the secondary transfer nip, timed to coincide with the arrival of the multicolor toner image on the intermediate transfer belt 8. Thus, a multicolor toner image is formed on the recording sheet P.

The recording sheet P having the multicolor toner image transferred at the secondary transfer nip is transported to the fixing device 20. In the fixing device 20, a fixing roller and a pressing roller apply heat and pressure to the recording sheet P to fix the multicolor toner image on the recording sheet P.

Subsequently, the recording sheet P is discharged by a pair of sheet ejection rollers outside the apparatus. The recording sheet P is discharged as an output image to the sheet stack section by the ejection rollers.

Thus, a sequence of image forming processes in the image forming apparatus 100 is completed.

Next, a detailed description is provided of a configuration and operation of the developing device 5Y referring to FIG. 2.

The developing device 5Y includes a developing roller 51Y disposed facing the photoconductor drum 1Y, two conveying screws 55Y disposed within the developing device 5Y a doctor blade 52Y opposed to the developing roller 51Y, and a density sensor 56Y to detect a toner density. The developing roller 51Y includes stationary magnets or a magnet roller and a sleeve that rotates around the magnets. The magnets generate magnetic poles around the circumferential surface of the developing roller 51Y. The developing device 5Y contains two-component developer including carrier (carrier particles) and toner (toner particles).

The developing device 5Y with such a configuration operates as follows.

The sleeve of the developing roller 51 rotes clockwise in FIG. 2. The developer held on the developing roller 51Y by the magnetic field generated by the magnets moves on the developing roller 51Y as the sleeve rotates. The developer within the developing device 5Y is adjusted to have a ratio of toner (density of toner) in the developer that falls within a predetermined range.

The two conveying screws 55Y stirs and mixes the developer with the toner added to the developer container while circulating the developer in the developer container that is separated into two parts. In this case, the developer moves in a direction perpendicular to the drawing sheet of FIG. 2. The toner particles in the developer adheres to carrier particles due to triboelectric charging with carrier particles so that the toner particles and the carrier particles are carried on the developing roller 51Y having a magnetic force generated.

The developer carried on the developing roller 51Y is conveyed in the clockwise direction in FIG. 2, achieving a position facing the doctor blade 52Y. After the developer on the developing roller 51 is adjusted to have an appropriate amount at the position facing the doctor blade 52Y, the developer is further conveyed to a position facing the photoconductor drum 1Y, the position of which belongs to a developing range. Then, the toner in the developer is adsorbed to the latent image formed on the photoconductor drum 1Y due to the effect of the magnetic field generated in the development range. The residual developer remaining on the developing roller 51Y moves forward with rotation of the sleeve, and arrives at a position above the developer container so that the residual developer separates from the developing roller 51Y at the position.

Figure 4:
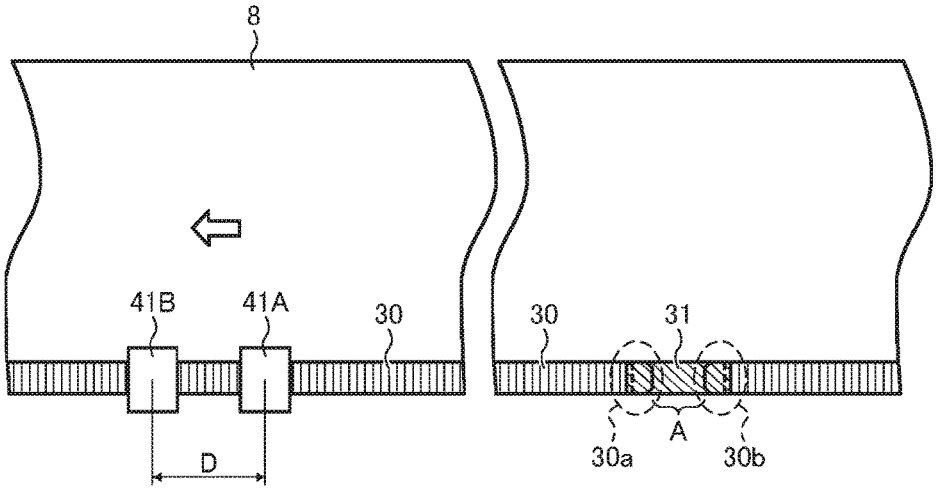
FIG. 4 is an illustration of the inner circumferential surface of the intermediate transfer belt according to an embodiment of the present disclosure.

Next, a description is provided of the intermediate transfer belt device 15 according to the present embodiment, referring to FIGS. 3 and 4.

As illustrated in FIG. 3, the intermediate transfer device 15 as the belt device includes the intermediate transfer belt 8 as a belt, four primary-transfer rollers 9Y, 9M, 9C, and 9K, a drive roller 12A, a secondary-transfer second roller 80, a tension roller 12B, driven rollers 12C and 12D, a cleaning roller 13, a belt cleaner 10, a secondary-transfer first roller 70, and a sensor unit 40 including a first optical sensor 41A and a second optical sensor 41B.

The intermediate transfer belt 8 as a belt is positioned facing the photoconductor drums 1Y, 1M, 1C, and 1K bearing the toner images of the respective colors. The intermediate transfer belt 8 is stretched taut around and supported by the rollers, such as the drive roller 12A, the secondary-transfer second roller 80, the tension roller 12B, the driven rollers 12C and 12D, and the cleaning roller 13.

According to the present embodiment, the intermediate transfer belt 8 includes a single layer or multiple layers including, but not limited to, polyimide (PI), polyvinylidene fluoride (PVDF), ethylene-tetrafluoroethylene copolymer (ETFE), and polycarbonate (PC), with conductive material such as carbon black dispersed therein. The volume resistivity of the intermediate transfer belt 8 is adjusted to range from $10^6$ [Ωcm] to $10^{13}$ [Ωcm], and the surface resistivity of the back surface of belt is adjusted to range from $10^7$Ω/sq and $10^{13}$Ω/sq. The thickness of the intermediate transfer belt 8 ranges from 20 to 200 μm. According to the present embodiment, the intermediate transfer belt 8 has a thickness of 60 μm, and a volume resistivity of $10^9$ [Ωcm].

In some embodiments, the intermediate transfer belt 8 may include a release layer on the surface of the intermediate transfer belt 8. In some embodiments, the release layer may include, but is not limited to, fluorocarbon resin such as ETFE, polytetrafluoroethylene (PTFE), PVDF, perfluoroalkoxy polymer resin (PFA), fluorinated ethylene propylene (FEP), and polyvinyl fluoride (PVF).

The intermediate transfer belt 8 is manufactured through a casting process, a centrifugal casting process, or the like. The surface of the intermediate transfer belt 8 may be polished as necessary. The volume resistivity of the intermediate transfer belt 8 according to the present embodiment is measured with an applied voltage of 100 V by a high resistivity meter, Hiresta UPMCPHT 45, manufactured by Mitsubishi Chemical Corporation.

In this case, the intermediate transfer belt 8 includes a scale tape 30 bonded along a lateral edge (a direction perpendicular to the drawing sheet of FIG. 3 or the vertical direction of the drawing sheet of FIG. 4) of the inner circumferential surface of the intermediate transfer belt 8. The scale tape 30 has scale patterns 30P and 30S formed on the surface of the scale tape 30. The first optical sensor 41A and the second optical sensor 41B are disposed facing the scale tape 30, which are described later.

The primary-transfer rollers 9Y, 9M, 9C, and 9K are opposed to the photoconductor drums 1Y, 1M, 1C, and 1K, respectively via the intermediate transfer belt 8. Specifically, the primary-transfer roller 9Y for yellow is opposed to the photoconductor drum 1Y for yellow via the intermediate transfer belt 8. The primary-transfer roller 9M for magenta is opposed to the photoconductor drum 1M for magenta via the intermediate transfer belt 8. The primary-transfer roller 9C for cyan is opposed to the photoconductor drum 1C for cyan via the intermediate transfer belt 8. The primary-transfer roller 9K for black is opposed to the photoconductor drum 1K for black via the intermediate transfer belt 8. Each of the primary-transfer roller 9Y, 9M, 9C, and 9K is an elastic roller including a core metal with a diameter of 10 mm and a conductive foamed layer with an outer diameter of 16 mm on the core metal. The volume resistivity of each of the primary-transfer roller 9Y, 9M, 9C, and 9K ranges from $10^7$ [Ωcm] to $10^8$ [Ωcm] and preferably ranges from $10^7$ [Ωcm] to $10^9$ [Ωcm].

The drive roller 12A is driven by a drive motor 91, which is controlled by a control circuit 90. Such a configuration allows the intermediate transfer belt 8 to travel (move) in a predetermined direction (clockwise in FIG. 3).

The tension roller 12B contacts the outer circumferential surface of the intermediate transfer belt 8. The driven rollers 12C and 12D contact the inner circumferential surface of the intermediate transfer belt 8. Between the secondary-transfer second roller 80 and the tension roller 12B is disposed the belt cleaner 10 (cleaning blade), which is opposed to the cleaning roller 13 via the intermediate transfer belt 8.

Referring to FIG. 3, the secondary-transfer second roller 80 contacts the secondary-transfer first roller 70 via the intermediate transfer belt 8. The secondary-transfer second roller 80 includes a cylindrical core metal made of a stainless steel having an elastic layer 83 on the outer circumferential surface of the core metal. The elastic layer 83 has a volume resistivity ranging from approximately $10^7$ [Ωcm] to $10^8$ [Ωcm], and a hardness ranging from approximately 48° to 58° on Japanese Industrial Standards (hereinafter, referred to as JIS)-A hardness scale. The elastic layer 83 has a thickness of approximately 5 mm.

According to the present embodiment, the secondary-transfer second roller 80 is electrically connected to a power source as a bias output device, which outputs a high voltage of −10 kV as a secondary transfer bias. With the secondary transfer bias output to the secondary-transfer second roller 80, the toner image is secondarily transferred from the bearing surface of the intermediate transfer belt 8 onto the recording sheet P conveyed to the secondary transfer nip. The secondary transfer bias has the same polarity as the polarity of the toner. With this configuration, the toner borne on the outer circumferential surface (toner bearing surface) of the intermediate transfer belt 8 electrostatically moves from the secondary-transfer second roller 80 to the secondary-transfer first roller 70.

The secondary-transfer first roller 70 contacts the toner bearing surface (the outer circumferential surface) of the intermediate transfer belt 8 to form the secondary transfer nip, to which the recording sheet P is conveyed. The secondary-transfer first roller 70 has an outer diameter of approximately 15.5 mm. The secondary-transfer first roller 70 includes a hollow core metal and an elastic layer (coating) on the core metal. The core metal is made of stainless steel or aluminum, having a diameter of approximately 9 mm. The elastic layer has a hardness ranging approximately from 40° through 50° on Asker C hardness scale. The elastic layer of the secondary-transfer first roller 70 may be a solid or foamed roller, in which conductive filler, such as a carbon, is scattered in rubber material, such as polyurethane, ethylene-propylene-diene monomer (EPDM), and silicone, or ionic conductive material is incorporated into such rubber material. According to the present embodiment, the elastic layer of the secondary-transfer first roller 70 has a volume resistivity ranging from $10^{6.5}$ [Ωcm] to $10^{7.5}$ [Ωcm] to prevent the concentration of the transfer electrical current.

Alternatively, in some embodiments, a release layer, such as a semiconductive fluororesin or a semiconductive urethane resin, is formed over the surface of the secondary-transfer first roller 70, thereby improving the ability of separation of the toner from the surface of roller.

Next, a detailed description is provided of the configuration and operation of the intermediate transfer belt device 15 as the belt device according to the present embodiment, referring to FIGS. 3 through 12.

Referring to FIGS. 3 through 12, the scale tape 30 is bonded along the surface of the intermediate transfer belt 8 formed into an endless belt that moves in a predetermined direction in the intermediate transfer device 15 as a belt device. On the surface of the scale tape 30, the scale patterns 30P and 30S are formed. That is, the scale tape 30 including two ends 30*a* (a first end) and 30*b* (a second end) is bonded along the surface of the intermediate transfer belt 8.

In the scale tape 30, the scale pattern 30P includes a plurality of reflective portions 30*p* made of material that reflects light and the scale pattern 30S includes a plurality of non-reflective portions 30*s* made of material that absorbs light instead of reflecting light. The reflective portions 30*p* and the non-reflective portions 30*s* alternate at a predetermined uniform pitch X.

According to the present embodiment, the scale tape 30 is bonded along the inner circumferential surface of the intermediate transfer belt 8 with a gap (space) A formed between the two ends 30*a* and 30*b*. That is, in the intermediate transfer belt device 15 according to the present embodiment, a gap A is formed between the two ends 30*a* and 30*b* on the intermediate transfer belt 8.

With such a gap A formed between the end 30*a* and 30*b* of the scale tape 30 bonded along the circumferential surface of the intermediate transfer belt 8, the ends 30*a* and 30*b* are less likely to separate from the intermediate transfer belt 8 than a case, in which the end 30*a* and the end 30*b* overlap each other to form a joint to bond the scale tape 30 and the inner circumferential surface of the intermediate transfer belt 8. This is because the bonding strength between the bonding surface of the end 30*a* and the surface of the intermediate transfer belt 8 is greater than the bonding strength between the bonding surface of the end 30*a* and the bonding surface of the second end 30*b*.

FIG. 12 is a cross-sectional view of the scale tape 30. According to the present embodiment, the scale tape 30 is constructed of a surface layer 30*m*, an intermediate layer 30*w*, and a bonding layer 30*n*. The surface layer 30*m* is made of polyethylene terephthalate (PET), having a thickness of approximately 25 μm. The intermediate layer 30*w* is an aluminum vapor deposition layer formed by subjecting aluminum with a thickness of approximately a couple μm to the vapor deposition process. The bonding layer 30*n* has a thickness of approximately 20 μm, which is made of adhesive to bond the scale tape 30 and the intermediate transfer belt 8. The intermediate layer 30*w*, which is an aluminum vapor deposition layer), includes a plurality of reflective portions 30*p*, each having a width of approximately a couple μm in a circumferential direction of the intermediate transfer belt 8. The plurality of reflective portions 30*p* is uniformly spaced.

It is to be noted that the scale patterns 30P and 30S are formed in the surface layer 30*m* of the scale tape 30 by etching or printing in some embodiments.

Figure 5:
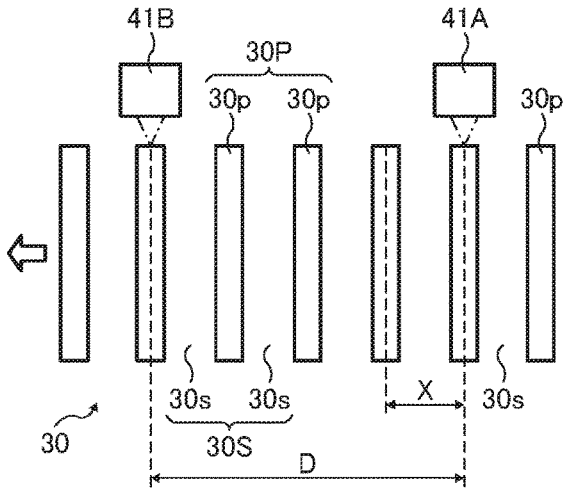
FIG. 5 is a schematic illustration of the relative positions of scale patterns and two optical sensors according to an embodiment of the present disclosure.

Referring to FIGS. 3 through 7, the first optical sensor 41A and the second optical sensor 41B as sensors to detect the scale patterns 30P and 30S are disposed facing the scale tape 30 on the inner circumferential surface of the intermediate transfer belt 8 in the intermediate transfer belt device 15. Referring particularly to FIGS. 4 and 5, the first optical sensor 41A and the second optical sensor 41B are separated from each other with a predetermined interval D between each other in the circumferential direction. The first optical sensor 41A is disposed upstream from the second optical sensor 41B in the circumferential direction.

Specifically, the interval D between the first optical sensor 41A and the second optical sensor 41B is an integral multiple of the pitch X of the scale patterns 30P and 30S, as illustrated in FIG. 5. In this case, a position at which light emitted from a light emitting element 42 to be described later is reflected from the intermediate transfer belt 8 is defined as a reference position. When the pitch X of the scale patterns 30P and 30S is accurately set as a target value, the phases of the output waveforms (pulse waveform or analog waveform) from the respective first and second optical sensors 41A and 41B coincide. By contrast, when the pitch X of the scale patterns 30P and 30S is not set as a target value due to the stretch and shrinkage of the intermediate transfer belt 8 (scale tape 30) with changes in environments, the phases of the output waveforms from the respective first and second optical sensors 41A and 41B shift from each other. According to the present embodiment, at least one of the first optical sensor 41A and the second optical sensor 41B detects the scale patterns 30P and 30S to detect the fluctuations in speed of movement of the intermediate transfer belt 8. In response to the detection result, a change in pitch X of the detected scale patterns 30P and 30S is corrected and the control circuit 90 adjusts the rotating speed of the drive motor 91, thus improving the speed of movement of the intermediate transfer belt 8 to prevent the occurrence of color misalignment.

Figure 6A:
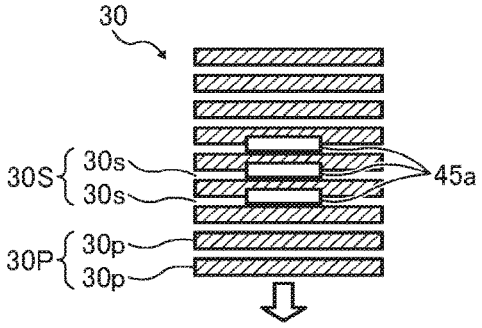
FIG. 6A is a schematic illustration of the relative positions of the scale patterns and slits of a fairing.
Figure 6B:
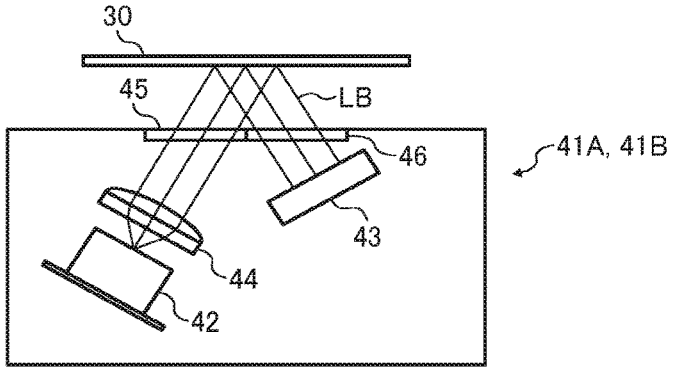
FIG. 6B is a schematic illustration of the optical sensors.

Referring to FIG. 6B, each of the first optical sensor 41A and the second optical sensor 41B includes a light emitting element 42, a photosensor 43, a collimator lens 44, a fairing (slit mask) 45 including a plurality of slits 45*a* formed, and a sensor window 46.

The light emitting element 42, such as a light emitting diode, emits light LB, which passes through the collimator lens 44, thereby becoming parallel light. The parallel light passes through the plurality of slits 45*a* of the fairing and enters the scale patterns 30P and 30S of the scale tape 30. The light, which is reflected from the reflective portions 30*p* of the scale patterns 30P and 30S, passes through the sensor window 46 and enters the photosensor 43, such as a phototransistor. In response to the amount of the received light (refer to the output waveforms illustrated in FIGS. 10A and 11), the photosensor 43 of the first optical sensor 41A and the second optical sensor 41B sends an output signal to the control circuit 90.

Figure 6C:
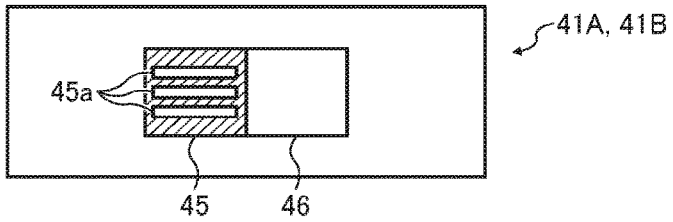
FIG. 6C is an schematic illustration of the fairing and a sensor window.

Each of the plurality of slits 45*a* of the fairing slit mask 45 has a pitch and shape determined according to the shape of the scale patterns 30P and 30S, as illustrated in FIGS. 6A and 6C. The plurality of slits 45*a* refers to three slits 45*a*, each having a rectangular shape in the present embodiment. With such a configuration, the reflected light adjusted to the shape of the scale patterns 30P and 30S (the reflective portions 30*p*) enters the photosensor 43, thereby allowing the detection of the scale patterns 30P and 30S with a high accuracy.

Figure 7:
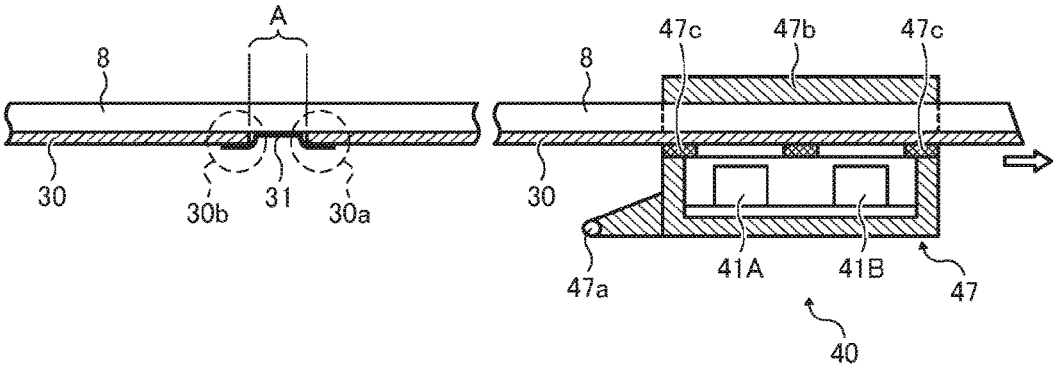
FIG. 7 is a cross-sectional view of a part of the intermediate transfer belt according to an embodiment of the present disclosure.

Referring to FIG. 7, the first optical sensor 41A and the second optical sensor 41B, which are held by a holder 47, constitute the sensor unit 40.

The holder 47 includes a presser plate 47*b* and a contact part 47*c* with the intermediate transfer belt 8 between the presser plate 47*b* and the contact part 47*c*. This arrangement restricts the fluttering of the intermediate transfer belt 8, thereby reducing changes in distance from the first optical sensor 41A and the second optical sensor 41B to the scale patterns 30P and 30S. With such a configuration, the scale patterns 30P and 30S are accurately detected by the first optical sensor 41A and the second optical sensor 41B.

The contact part 47*c* is made of low-friction material, such as Teflon® tape, to prevent the damage to the scale tape 30 including the scale patterns 30P and 30S.

The sensor unit 40 is rotatable about the rotary shaft 47*a* of the holder 47, relative to the housing of the intermediate transfer belt device 15. This configuration eliminates or reduces changes in distance from the first optical sensor 41A and the second optical sensor 41B to the scale patterns 30P and 30S even when the intermediate transfer belt 8 is loosen or the intermediate transfer belt 8 displaces to separate from the photoconductor drums 1Y, 1M, and 1C and contact the photoconductor drum 1K in the monochrome mode. With such a configuration, the scale patterns 30P and 30S are accurately detected by the first optical sensor 41A and the second optical sensor 41B.

In the intermediate transfer belt device 15 according to the present embodiment, the rollers (the primary transfer rollers 9Y, 9M, 9C, and 9K, the drive roller 12A, the secondary-transfer second roller 80, the driven rollers 12C and 12D, and the cleaning roller 13) that contact the inner circumferential surface of the intermediate transfer belt 8 have a configuration that prevents interference with the scale tape 30 or an auxiliary tape (reinforcing tape) 31 to be described later due to the lateral edge of the intermediate transfer belt 8 being raised by an amount equivalent to the thickness of the scale tape 30 or the auxiliary tape 31 covering the intermediate transfer belt 8. In this case, the width direction refers to the direction perpendicular to the circumferential direction as described above.

Figure 8:
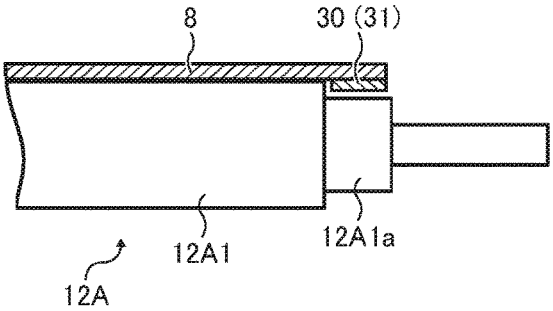
FIG. 8 is a cross-sectional view of a part of the intermediate transfer belt stretched by a roller.

Specifically, referring to FIG. 8, the drive roller 12A includes a first roller 12A1 including a second roller 12A1*a* with a smaller diameter than the diameter of the first roller 12A1 to prevent interference with the scale tape 30 or an auxiliary tape 31. Such a configuration prevents the intermediate transfer belt 8 from shifting in the width direction due to the raised lateral edge of the intermediate transfer belt 8.

It is to be noted that the other rollers, such as the primary-transfer rollers 9Y, 9M, 9C, and 9K; the secondary-transfer second roller 80; the driven rollers 12C and 12D; and the cleaning roller 13, that contact the inner circumferential surface of the intermediate transfer belt 8 have substantially the same configurations as the configuration of the drive roller 12A of FIG. 8.

Referring once again to FIG. 3, the intermediate transfer belt device 15 according to the present embodiment includes a cleaner 60 to eliminate foreign substances, such as toner, adhering to the surface of the scale tape 30.

Specifically, the cleaner 60 includes a first cleaner 60*a* and a second cleaner 60*b*. The first cleaner 60*a*, which is made of, e.g., fibers, directly cleans the scale tape 30 bonded along the inner circumferential surface of the intermediate transfer belt 8. The second cleaner 60*b* contacts the outer circumferential surface of the intermediate transfer belt 8 to hold the scale tape 30 bonded onto the intermediate transfer belt 8, between the first cleaner 60*a* and the second cleaner 60*b*. The cleaner 60 is disposed downstream from the drive roller 12A and upstream from the secondary transfer nip in the direction of movement of the intermediate transfer belt 8.

According to the present embodiment, a second motor, separately from the drive motor 91 as a driver for the intermediate transfer belt 8, drives the secondary-transfer first roller 70 to move. The second motor controls the secondary-transfer first roller 70 to rotate at a linear velocity in the secondary transfer nip that is different from the linear velocity of the intermediate transfer belt 8. With the difference in linear velocity at the secondary transfer nip, the recording sheet P is loosened, thereby reducing the impact generated when the recording sheet P passes through the registration rollers 28. Further, with such a configuration, the speed of the surface of the toner image on the intermediate transfer belt 8 is made equal to the speed of the surface of the recording sheet P. In such a configuration with the difference in linear velocity at the secondary transfer nip, when the secondary-transfer first roller 70 rotates at a lower speed than the speed of movement of the intermediate transfer belt 8, the intermediate transfer belt 8 may be loosen between the drive roller 12A and the secondary transfer nip. With the intermediate transfer belt 8 loosen between the drive roller 12A and the secondary transfer nip, the intermediate transfer belt 8 locally bends at a corner of the cleaner 60 disposed between the drive roller 12A and the secondary transfer nip.

As illustrated in FIGS. 4, 7, and 9A, in the intermediate transfer belt device 15 according to the present embodiment, an auxiliary tape 31 covers at least one of the two ends 30*a* and 30*b* on the intermediate transfer belt 8. Specifically, the intermediate transfer belt device 15 includes the auxiliary tape 31 covering at least two ends, 30*a* and 30*b*, of the scale tape 30 on the inner circumferential surface of the intermediate transfer belt 8. The auxiliary tape 31 also covers all or part of the gap A between the ends 30*a* and 30*b*.

More specifically, as illustrated in FIGS. 4, 7, and 9A, the auxiliary tape 31 according to the present embodiment covers the two ends 30*a* and 30*b* and all of the gap A. Thus, the auxiliary tape 31 covers the two ends 30*a* and 30*b* to fill the gap A.

With such a configuration that includes the auxiliary tape 31 covering the ends 30*a* and 30*b* of the scale tape 30 on the intermediate transfer belt 8 to fill the gap A, the ends 30*a* and 30*b* are reinforced with the auxiliary tape 31 to prevent the ends 30*a* and 30*b* having repeatedly received a bending force particularly at a position, at which the inner circumferential surface of the intermediate transfer belt 8 is stretched to bend, e.g., the position of the tension roller 12B, from separating from the intermediate transfer belt 8. Thus, the scale tape 30 is reliably prevented from separating from the intermediate transfer belt 8 due to the separation of at least one of the ends 30*a* and 30*b*.

According particularly to the present embodiment, the sensor unit 40 including the holder 47 is rotatable about a rotary shaft 47*a*. Such a configuration applies a force to stretch the inner circumferential surface of the intermediate transfer belt 8 between the presser plate 47*b* and the contact part of the holder 47 by using the auxiliary tape 31.

According to the present embodiment, the auxiliary tape 31 prevents the ends 30*a* and 30*b* of the scale tape 30 from separating from the intermediate transfer belt 8 disposed between the first cleaner 60*a* and the second cleaner 60*b*. Specifically, when the intermediate transfer belt 8 receives a bending force to locally bend at a corner, at which the cleaner 60 is disposed to hold the intermediate transfer belt 8 between the first cleaner 60*a* and the second cleaner 60*b*, the ends 30*a* and 30*b* of the scale tape 30 may repeatedly receive the bending force, which causes the ends 30*a* and 30*b* to easily separate from the intermediate transfer belt 8. Accordingly, the use of auxiliary tape 31 is effective to prevent such a separation of the ends 30*a* and 30*b* of the scale tape 30.

It is to be noted that, in addition to the cleaner 60 of FIG. 3, in some embodiments a second cleaner is disposed upstream of the sensor unit 40 in the direction of movement of the intermediate transfer belt 8, in some embodiments. For example, in FIG. 7, a second cleaner is disposed at the upstream end of the presser plate 47*b* of the sensor unit 40, to contact the scale tape 30.

In this case, according to the present embodiment, the auxiliary tape 31 has a greater bonding strength relative to the intermediate transfer belt 8 than the bonding strength of the scale tape 30 relative to the intermediate transfer belt 8.

Specifically, the scale tape 30 has a bonding strength ranging from approximately 0.5 through 3 N/10 mm, which is a load applied when the scale tape 30 is separated by a width of 10 mm in a direction of an angle of 90°. Preferably, the auxiliary tape 31 has a bounding strength, which is approximately 1.2 through 2 times as much as the bounding strength of the scale tape 30.

Such a configuration more reliably prevents the scale tape 30 from separating from the intermediate transfer belt 8.

In this case, according to the present embodiment, the auxiliary tape 31 has a lower surface friction coefficient than the surface friction coefficient of the scale tape 30. That is, the auxiliary tape 31 has a smoother surface than the scale tape 30 does.

With such a configuration, foreign substances, such as toner floating in the interior of the apparatus body, are less likely to adhere to or accumulate on the surface of the auxiliary tape 31. Accordingly, the configuration according to the present embodiment reliably prevents a deterioration in the accuracy of detection of the scale patterns 30P and 30S by the optical sensors 41A and 41B. Such a deterioration in the accuracy of detection occurs with the passage of time. With the passage of time, such foreign substances adhere to the surface or periphery of the auxiliary tape 31 covering the scale tape 30. The foreign substances move from the auxiliary tape 31 to the optical sensors 41A and 41B (particularly to the fairing 45 and the sensor window 46), thereby deteriorating the accuracy of detection of the scale patterns 30P and 30S by the optical sensors 41A and 41B. Preventing the deterioration in the accuracy of detection of the optical sensors 41A and 41B allows a stable drive control of the intermediate transfer belt 8 even with the passage of time.

As illustrated in FIG. 9A, the auxiliary tape 31 according to the present embodiment has a sufficient length in the direction of movement to prevent the exposure of chamfers 30*a*1 and 30*b*1 formed at the first end 30*a* and the second end 30*b*, respectively.

As illustrated in FIG. 9B, with the auxiliary tape 31 having an insufficient length in the direction of movement, thereby exposing the chamfers 30*a*1 and 30*b*1, the auxiliary tape 31 may fail to prevent the ends 30*a* and 30*b* from separating from the intermediate transfer belt 8.

As illustrated in FIG. 9A, the auxiliary tape 31 according to the present embodiment, which covers the scale tape 30 and the intermediate transfer belt 8, has a width falling within the range of the width of the scale tape 30 in the width direction perpendicular to the circumferential direction or in the vertical direction of the drawing sheet of FIG. 9A (hereinafter, referred to as the width direction).

Referring to FIG. 9C, with the auxiliary tape 31 having a width exceeding the width of the scale tape 30, an unevenness is generated between the inner circumferential surface of the intermediate transfer belt 8, the surface of the scale tape 30, and the surface of the auxiliary tape 31 so that foreign substances, such as toner, are likely to accumulate on the intermediate transfer belt 8, the scale tape 30, and the auxiliary tape 31. This leads to contamination of the first optical sensor 41A and the second optical sensor 41B.

To reduce such unevenness, which causes the accumulation of the foreign substances, the auxiliary tape 31 preferably has the same width as the scale tape 30 does in the width direction perpendicular to the circumferential direction.

Preferably, the auxiliary tape 31 includes a surface layer 31*m* and an adhesive layer. The surface layer 31*m* is made of Ultra High Molecular Weight Polyethylene (UHMWPE), having a thickness ranging from 20 through 100 μm. The adhesive layer is disposed below the surface layer 31*m*, the adhesive layer including adhesive or double-sided adhesive tape to cover the intermediate transfer belt 8. Alternatively, in some embodiment, the auxiliary tape 31 includes a surface layer 31*m* made of polyethyleneterephthalate (PET) or fluororesin, the surface layer 31*m* having a thickness ranging from approximately 60 through 80 μm. The auxiliary tape 31 according to the present embodiment includes a surface layer 31*m* made of the UHMWPE with a thickness of 30 μm and an adhesive layer.

Alternatively, in some embodiments, the auxiliary tape 31 is made of transparent material to allow light to permeate the auxiliary tape 31. Alternatively, in some embodiments, the auxiliary tape 31 is made of black-colored material to absorb light. The use of a light-permeable auxiliary tape 31 allows the detection of the first optical sensor 41A and the second optical sensor 41B with the light reflectivity of a component disposed below the auxiliary tape 31. The use of a light absorbing auxiliary tape 31 allows the detection of the first optical sensor 41A and the second optical sensor 41B with the light absorptivity of the auxiliary tape 31 itself. In any cases, the auxiliary tape 31 has a low surface friction coefficient, which prevents the damage to or the adherence of the foreign substances, such as toner, onto the surface of the auxiliary tape 3, thus allowing a successful detection of the first optical sensor 41A and the second optical sensor 41B even with the passage of time.

Specifically, according to the present embodiment, the control circuit 90 detects a gap A based on signals output from the first optical sensor 41A and the second optical sensor 41B when a portion covered by the auxiliary tape 31 passes by the first optical sensor 41A and the second optical sensor 41B. Alternatively, the control circuit 90 detects the gap A based on the signals output from the first optical sensor 41A and the second optical sensor 41B when the portion not covered by the auxiliary tape 31 passes by the first optical sensor 41A and the second optical sensor 41B. The control circuit 90 does not adjust the speed of movement of the intermediate transfer belt 8 in response to the output signals corresponding to the gap A from the optical sensors 41A and 41B. That is, the output waveform corresponding to the portion covered by the auxiliary tape 31 (gap A) as illustrated in FIG. 10A is preliminarily stored. The control circuit 90 identifies the gap A when the output waveform from the optical sensors 41A and 41B is equal to the preliminarily stored waveform. In response to the output waveform corresponding to the scale patterns 30P and 30S except for the gap A, the control circuit 90 adjusts the speed of movement of the intermediate transfer belt 8.

According to the present embodiment of this disclosure, the auxiliary tape 31 with a low surface friction coefficient is employed to eliminate or reduce any damage to the surface of the auxiliary tape 31 or the adherence of foreign substances, such as toner, onto the surface of the auxiliary tape 3. Such a configuration prevents the failure in detection of the gap A by the first optical sensor 41A and the second optical sensor 41B or prevents an erroneous detection of another portion other than the gap A.

Specifically, as illustrated in FIG. 10A, the output waveform corresponding to the portion covered by the auxiliary tape 31 does not fluctuate over time because the surface of the auxiliary tape 31 is not likely to be damaged or contaminated by foreign substances. Even when the surface of scale patterns 30P and 30S is damaged or subjected to the adherence of the foreign substances over time and the output waveform corresponding to the damaged or subjected portion of the scale patterns 30P and 30S fluctuates in a manner as indicated by a broken line in FIG. 10B, the gap A is not erroneously detected as another portion other than the gap A by the first optical sensor 41A and the second optical sensor 41B.

Referring to FIG. 10B, without the auxiliary tape 31 or with the auxiliary tape 31 that is likely to be damaged or subjected to the adherence of the foreign substances, the gap A is likely to be damaged or subjected to the adherence of the foreign substances, thereby damaging or contaminating the surface of the scale patterns 30P and 30S over time. As a result, the output waveform corresponding to the damaged or contaminated portion of the scale patterns 30P and 30S fluctuates in a manner as indicated by a broken line in FIG. 10B. This fluctuation of the output waveform leads to an erroneous detection of the gap A as another portion other than the gap A by the first optical sensor 41A and the second optical sensor 41B.

According to the present embodiment of this disclosure, using the auxiliary tape 31 with a low surface friction coefficient prevents such an erroneous detection, thereby allowing the control circuit 90 to successfully control the drive of the intermediate transfer belt 8 even with the passage of time.

Preferably, the length $A_1$ of the gap A in the circumferential direction is longer than the pitch X of the scale patterns 30P and 30S to reliably detect the gap A.

According to the present embodiment, the predetermined interval D between the two optical sensors 41A and 41B in the circumferential direction as illustrated in FIGS. 4 and 5 is longer than the length B of the auxiliary tape 31 in the circumferential direction as illustrated in FIG. 10A. That is, the value of B is smaller than the value of D.

With such a configuration, the first optical sensor 41A disposed upstream of the second optical sensor 41B first detects the gap A before the second optical sensor 41B detects the gap A covered by the auxiliary tape 31 and the output waveform corresponding to the gap A is less likely to fluctuate, as illustrated in FIG. 11. In response to the detection of a change in pitch X of the scale patterns 30P and 30S by the two optical sensors 41A and 41B, the control circuit 90 controls the drive of the intermediate transfer belt 8 by the amount of correction of the change in pitch X of the scale patterns 30P and 30S, resulting in an accurate detection of the gap A by at least one of the two optical sensors 41A and 41B.

Thus, as indicated by a broken line in FIG. 11, with a configuration, in which the interval D (D' in FIG. 11) between the first optical sensor 41A and the second optical sensor 41B is shorter than the length B of the auxiliary tape 31 in the circumferential direction, the control circuit 90 fails to control the drive of the intermediate transfer belt 8 by the amount of correction of a change in pitch X of the scale patterns 30P and 30S. As a result, the first optical sensor 41A and the second optical sensor 41B are more likely to erroneously detect the gap A.

According to the present embodiment, the control circuit 90 stops the intermediate transfer belt 8 moving in a predetermined direction with the gap A of the scale tape 30 positioned at a planar surface, at which the intermediate transfer belt 8 does not bend. That is, the control circuit 90 controls the drive motor 91 to stop the intermediate transfer belt 8 moving in a predetermined direction with the gap A of the scale tape 30 positioned at a planar portion, at which the intermediate transfer belt 8 does not bend.

In the case, in which the gap A is maintained at a position, at which the intermediate transfer belt 8 bends, for a long time with the stop of driving of the intermediate transfer belt 8, a bending force is applied to the ends 30*a* and 30*b* of the scale tape 30 for a long time, resulting in separation of at least one of the ends 30*a* and 30*b*. In this case, the position, at which the intermediate transfer belt 8 bends, refers to the position of the tension roller 12B, at which the inner circumferential surface of the intermediate transfer belt 8 is stretched to bend, and the positions of the drive roller 12A, the secondary-transfer second roller 80, the driven rollers 12C and 12D, and the rotatable sensor unit 40, at which the outer circumferential surface of the intermediate transfer belt 8 is stretched to bend. Thus, with the gap A positioned at a planar portion except for the positions, at which the intermediate transfer belt 8 locally bends, while the drive of the intermediate transfer belt 8 stops, the separation of the ends 30*a* and 30*b* of the scale tape 30 is more reliably prevented.

Specifically, a time period from the detection of the gap A by the optical sensors 41A and 41B to the stop of driving of the intermediate transfer belt 8 is managed to prevent the gap A between the ends 30*a* and 30*b* from being positioned at the portions, at which the intermediate transfer belt 8 locally bend, when the driving of the intermediate transfer belt 8 is stopped.

According to the present embodiment of this disclosure, the auxiliary tape 31 covers at least one of the ends 30*a* and 30*b* of the scale tape 30 bonded along the intermediate transfer belt 8. The auxiliary tape 31 according to the present embodiment has a surface friction coefficient lower than the surface friction coefficient of the scale tape 30.

Such a configuration prevents the scale tape 30 including two ends 30*a* and 30*b* from separating from the intermediate transfer belt 8, thereby allowing a successful detection of the scale patterns 30P and 30S of the scale tape 30 by the optical sensors 41A and 41B.

A detailed description is provided of an aspect according to another (a second) embodiment of the present disclosure, referring to FIGS. 13 and 14.

FIG. 13 is a cross-sectional view of a portion of the intermediate transfer belt according to the second embodiment of the present disclosure. The portion of FIG. 13 corresponds to the left side of FIG. 7. FIG. 14 is a graph of a change in the output waveform from at least one of the optical sensors 41A and 41B when a gap C between the ends 30*a* and 30*b* of the scale tape 30 passes by at least one of the optical sensors 41A and 41B. The graph of FIG. 14 corresponds to the graph of FIG. 10A.

The intermediate transfer belt device 15 according to the second embodiment of the present disclosure differs from that of the first embodiment of the present disclosure in the position of the auxiliary tape 31 covering the scale tape 30 in the intermediate transfer belt 8.

The intermediate transfer belt device 15 according to the second embodiment as the belt device also includes the intermediate transfer belt 8 as a belt, four primary-transfer rollers 9Y, 9M, 9C, and 9K, a drive roller 12A, a secondary-transfer second roller 80, a tension roller 12B, driven rollers 12C and 12D, a cleaning roller 13, a belt cleaner 10, a secondary-transfer first roller 70, and a sensor unit 40 including a first optical sensor 41A and a second optical sensor 41B, as in the first embodiment.

The intermediate transfer belt 8 according to the second embodiment of the present disclosure also includes a scale tape 30, which has two ends 30*a* (a first end) and 30*b* (a second end), bonded along a lateral edge of the intermediate transfer belt 8 with a gap A formed between the ends 30*a* and 30*b*, as in the first embodiment. The scale tape 30 according to the second embodiment also has scale patterns 30P and 30S formed on the surface of the scale tape 30. The intermediate transfer belt 8 according to the second embodiment also includes an auxiliary tape 31 covering at least one of the ends 30*a* and 30*b* on the intermediate transfer belt 8, as in the first embodiment.

As illustrated in FIG. 13, the intermediate transfer belt device 15 according to the second embodiment differs from that of the first embodiment in that, in the second embodiment, the auxiliary tape 31 covers the entire surface of the scale tape 30 from the first end 30*a* to the second end 30*b* in the intermediate transfer belt 8 and a gap C having a shorter length in the circumferential direction than the length of the gap A is formed within the range of the gap A. Specifically, the gap C smaller than the gap A is formed within the gap A between the ends 30*a* and 30*b* of the scale tape 30. The auxiliary tape 31 having the same length as the length in the width direction of the scale tape 30 covers all of the scale tape 30 except for the gap C. The auxiliary tape 31 according to the second embodiment also has a lower surface friction coefficient than the surface friction coefficient of the scale tape 30.

With such a configuration as well, the two ends 30*a* and 30*b* of the scale tape 30 are reinforced with the auxiliary tape 31 to prevent the ends 30*a* and 30*b* from separating from the intermediate transfer belt 8, thus reliably preventing the scale tape 30 from separating from the intermediate transfer belt 8 due to the separation of at least one of the ends 30*a* and 30*b*.

Further, a foreign substance, such as toner, floating in the interior of the apparatus body is less likely to adhere to or accumulate on the surface of the auxiliary tape 31. Accordingly, the configuration according to the second embodiment reliably prevents a deterioration in the accuracy of detection of the scale patterns 30P and 30S by the optical sensors 41A and 41B. Such a deterioration in the accuracy of detection occurs with the passage of time. With the passage of time, foreign substances, such as toner, adheres to the surface or the periphery of the auxiliary tape 31 covering all of the scale tape 30. The foreign substances move from the auxiliary tape 31 to the optical sensors 41A and 41B, thereby deteriorating the accuracy of detection of the scale patterns 30P and 30S by the optical sensors 41A and 42B.

According to the second embodiment of the present disclosure as well, the auxiliary tape 31 with a low surface friction coefficient is employed to eliminate or reduce any damage to the surface of the auxiliary tape 31 or the adherence of a foreign substance, such as toner, onto the surface of the auxiliary tape 3. Such a configuration prevents failure in detection of the gap A by the first optical sensor 41A and the second optical sensor 41B or prevents an erroneous detection of a portion except for the gap A.

Specifically, as illustrated in FIG. 14, the output waveform corresponding to the portion (all of the scale tape 30) covered by the auxiliary tape 31 does not fluctuate in a height direction of the waveform over time because the surface of the auxiliary tape 31 is not likely to be damaged or subjected to the adherence of foreign substances. Even when the gap A (the gap C of the auxiliary tape 31) of the scale tape 30 is damaged or subjected to the adherence of foreign substances and the output waveform corresponding to the portion covered by the damaged or subjected surface fluctuates in a manner as indicated by a broken line in FIG. 14, the gap A (gap C) is not erroneously detected as a portion that is not the gap A (the gap C) by the first optical sensor 41A and the second optical sensor 41B. Such a configuration allows a successful drive control of the intermediate transfer belt 8 even with the passage of time.

According to the second embodiment of this disclosure, the auxiliary tape 31 covers at least one of the ends 30*a* and 30*b* of the scale tape 30 bonded to the intermediate transfer belt 8. The auxiliary tape 31 according to the present embodiment has a surface friction coefficient lower than the surface friction coefficient of the scale tape 30.

Such a configuration prevents the scale tape 30 including two ends 30*a* and 30*b* from separating from the intermediate transfer belt 8, thereby allowing a successful detection of the scale patterns 30P and 30S of the scale tape 30 by the optical sensors 41A and 41B.

The present disclosure is not limited to the belt device (the intermediate transfer belt device 15) including the intermediate transfer belt 8 as a belt according to the embodiments described above. For example, the present disclosure is applied to a belt device including a belt, such as a transfer conveyance belt, a photoconductor belt, and a fixing belt as long as such a belt device includes a scale tape and an optical sensor.

The present disclosure is not limited to the intermediate transfer belt device 15 including the scale tape 30 bonded along the inner circumferential surface of the intermediate transfer belt 8 according to the embodiments described above. The intermediate transfer belt device 15 including the scale tape 30 along the outer circumferential surface of the intermediate transfer belt 8 is applicable.

The present disclosure is not limited to the intermediate transfer belt device 15 including two optical sensors 41A and 41B to detect the scale patterns 30P and 30S of the scale tape 30 on the intermediate transfer belt 8. The intermediate transfer belt device 15 may include one optical sensor. Alternatively, the intermediate transfer belt may include more than or equal to three optical sensors.

In any cases, the same advantageous effects as in the embodiments described above are exhibited.

The present disclosure is applied to the intermediate transfer belt device 15 including the scale tape 30 bonded along the intermediate transfer belt 8 with a gap A between the ends 30*a* and 30*b* of the scale tape 30 according to the embodiments described above. According to the embodiments described above, such a gap A is formed between the ends 30*a* and 30*b* of the scale tape 30, thereby allowing the auxiliary tape 31 to cover the surface of the intermediate transfer belt 8, thus increasing the bonding strength of the auxiliary tape 31.

However, the present disclosure is not limited to the intermediate transfer belt device 15 including the scale tape 30 bonded with the gap A formed between the ends 30*a* and 30*b* of the scale tape 30. The intermediate transfer belt device 15 including the scale tape 30 bonded along the intermediate transfer belt 8 with the ends 30*a* and 30*b* meeting with each other, i.e., without the gap A formed between the ends 30*a* and 30*b* is also applicable. In such a case as well, the use of the auxiliary tape 31 prevents the scale tape 30 from separating from the intermediate transfer belt 8. Further, with the configuration, in which the auxiliary tape 31 has a lower surface friction coefficient than the surface friction coefficient of the scale tape 30, foreign substances, such as toner, are prevented from adhering to the surface or periphery of the auxiliary tape 31, thus allowing a successful detection of the scale patterns 30P and 30S by the optical sensors 41A and 42B. With the auxiliary tape 31 in the configuration, in which the gap A is not formed between the ends 30*a* and 30*b* of the scale tape 30, the length of the auxiliary tape 31 in the circumferential direction is shortened, thereby reducing costs for parts. In such a configuration, the auxiliary tape 31 covers the ends 30*a* and 30*b* of the scale tape 30. Alternatively, the auxiliary tape 31 covers the ends 30*a* and 30*b*, and the surface of the intermediate transfer belt 8.

Numerous additional modifications and variations are possible in light of the above teachings. It is therefore to be understood that within the scope of the appended claims, the present disclosure may be practiced otherwise than as specifically described herein. Such variations are not to be regarded as a departure from the scope of the present disclosure and appended claims, and all such modifications are intended to be included within the scope of the present disclosure and appended claims. The number, position, and shape of the components of the image forming apparatus described above are not limited to those described above.

What is claimed is:

1. A belt device comprising:

an endless rotatable belt;

a scale tape having a first end and a second end and including a scale pattern, the scale tape bonded on the belt;

an optical sensor to detect the scale pattern; and an auxiliary tape to cover at least one of the first end and the second end of the scale tape on the belt, the auxiliary tape having a lower surface friction coefficient than a surface friction coefficient of the scale tape.

2. The belt device according to claim 1, wherein the auxiliary tape has a greater bonding strength relative to the belt than a bonding strength of the scale tape relative to the belt.

3. The belt device according to claim 1, wherein a gap is formed between the first end and the second end of the scale tape on the belt, and wherein the auxiliary tape covers the gap.

4. The belt device according to claim 3, wherein the auxiliary tape is bonded on the belt and the scale tape to cover the first end, the second end, and the gap.

5. The belt device according to claim 3, further comprising another optical sensor disposed away from the optical sensor with an interval in a circumferential direction of the belt, wherein the interval between said another optical sensor and the optical sensor is longer than a length of the auxiliary tape in the circumferential direction.

6. The belt device according to claim 3, wherein the auxiliary tape is bonded on the belt and the scale tape within a range of a length of the scale tape in a width direction perpendicular to a circumferential direction of the scale tape.

7. The belt device according to claim 3, further comprising a control circuit to control a drive of the belt in response to an output from the optical sensor, wherein the control circuit detects the gap in response to an output from the optical sensor when a portion of the belt covered by the auxiliary tape passes a detection position of the optical sensor or in response to another output from the optical sensor when another portion of the belt uncovered by the auxiliary tape passes the detection position of the optical sensor.

8. The belt device according to claim 1, wherein a first gap is formed between the first end and the second end on the belt, wherein the auxiliary tape covers an entire surface of the scale tape ranging from the first end to the second end to form a second gap having a shorter length in a circumferential direction than a length of the first gap within a range of the first gap in the belt.

9. The belt device according to claim 1, further comprising:

a drive roller to support the belt;

a drive motor to drive the drive roller; and a control circuit to control the drive motor, wherein the control circuit controls the drive motor to stop the belt with the gap of the scale tape positioned at a planar portion, at which the belt does not bend.

10. The belt device according to claim 1, wherein the scale tape includes a surface layer made of polyethylene terephthalate, wherein the auxiliary tape includes a surface layer made of ultra-high molecular weight polyethylene to be optically transmissive, and wherein the surface layer of the auxiliary tape has a thickness ranging from 20 to 100 μm.

11. An image forming apparatus comprising the belt device according to claim 1.

* * * * *